US005755529A

United States Patent [19]

Follett

[11] Patent Number: 5,755,529

[45] Date of Patent: May 26, 1998

[54] BOAT LIFT

[76] Inventor: R.R. Brad Follett, 712 West Chestermere Dr., Chestermere, Alberta, Canada

[21] Appl. No.: 652,384

[22] Filed: May 23, 1996

[51] Int. Cl.[6] ..... B63C 3/06

[52] U.S. Cl. ..... 405/3; 114/48

[58] Field of Search ..... 405/1–7; 114/44–48

[56] References Cited

U.S. PATENT DOCUMENTS

| | | | |
|---|---|---|---|
| 2,505,832 | 5/1950 | Lange | 405/3 |
| 4,027,492 | 6/1977 | Carpenter | 405/3 |
| 4,037,421 | 7/1977 | Whitley | 405/3 |
| 4,787,327 | 11/1988 | Porter | 405/3 X |
| 5,380,143 | 1/1995 | Mohan | 114/48 X |

FOREIGN PATENT DOCUMENTS

| | | | |
|---|---|---|---|
| 788826 | 7/1968 | Canada | 405/3 |

*Primary Examiner*—Dennis L. Taylor
*Attorney, Agent, or Firm*—David Thompson

[57] ABSTRACT

A boat lift for lifting a boat above the water adjacent to a wharf on a water bed comprises a wharf attachment mounted to the wharf above the water; a frame having a wharf end portion hinged adjacent to the wharf attachment; a footing seated on the water bed beneath the outer end portion of the frame; and scissor arms one having a top end portion which is hinged to the outer portion of the frame; the other having a top end portion which is hinged to the lower end portion of the upper scissor arm and a lower end portion which is hinged to the footing therebelow; and opening/closing means to alternatively fold the scissor arms together and open them to a straight in-line position; whereby when the scissor arms are in a closed position the outer end portion of the frame is in a lowered position beneath the water so that a boat may be driven above the frame onto the wharf end portion thereof, and then when the scissor arms are straightened to an in-line position the boat is first fully seated on the frame and then lifted out of the water. In one aspect of the invention the opening/closing means is a manually powered winch. In another aspect of the invention, preferred for larger boats, the opening/closing means is a water driven hydraulic cylinder which can be fabricated from PVC plumbing pipes and fittings.

16 Claims, 3 Drawing Sheets

BOAT LIFT

FIELD OF THE INVENTION

This invention relates to boat lifts. More particularly this invention relates to boat lifts used adjacent to docks to lift boats in a docking position out of the water.

BACKGROUND OF THE INVENTION

Boat owners prefer to store their boats out of the water. Boats stored in water not only tend to become covered with plant growth but are constantly agitated by water movement. On windy days waves batter the boat and cause wear between the dock and the boat. Absentee boat owners worry. They never know whether their boats are swamped or aimlessly adrift.

The problem with totally removing the boat from the water is that it is time consuming and inconvenient both before and after use.

OBJECTS AND STATEMENT OF THE INVENTION

It is an object of this invention to disclose a boat lift which may be used to lift and store a boat above the water adjacent to a dock. It is an object of this invention to disclose a boat lift which may be used to lift and store a boat above the water in a boat house. It is a further object of this invention to disclose a boat lift which is convenient to use. It is yet a further object of this invention to disclose a boat lift which is economical to build and operate and which may be readily designed to fit any size and weight of boat.

One aspect of this invention provides for a boat lift for lifting a boat from the water adjacent to a wharf beside a water bed. It comprises a wharf attachment mounted to the wharf above the water; a frame having a wharf end portion hinged adjacent to the wharf attachment; a footing seated on the water bed beneath the outer end portion of the frame; an upper scissor arm having a top end portion which is hinged to the outer portion of the frame; a lower scissor arm having a top end portion which is hinged to the lower end portion of the upper scissor arm and a lower end portion which is hinged to the footing therebelow; and opening/closing means to alternatively fold the scissor arms together and open them to a straight in-line position; whereby when the scissor arms are in a closed position the outer end portion of the frame is in a lowered position beneath the water so that a boat may be driven above the frame onto the wharf end portion thereof, and then when the scissor arms are straightened to an in-line position the boat is first fully seated on the frame and then lifted out of the water.

In one aspect of the invention the opening/closing means is a manually powered winch. In another aspect of the invention, preferred for larger boats the opening/closing means is water is water driven hydraulic cylinder which can be fabricated from PVC plumbing pipes and fittings.

Various other objects, advantages and features of this invention will become apparent to those skilled in the art from the following description in conjunction with the accompanying drawings.

FIGURES OF THE INVENTION

Figure 1:
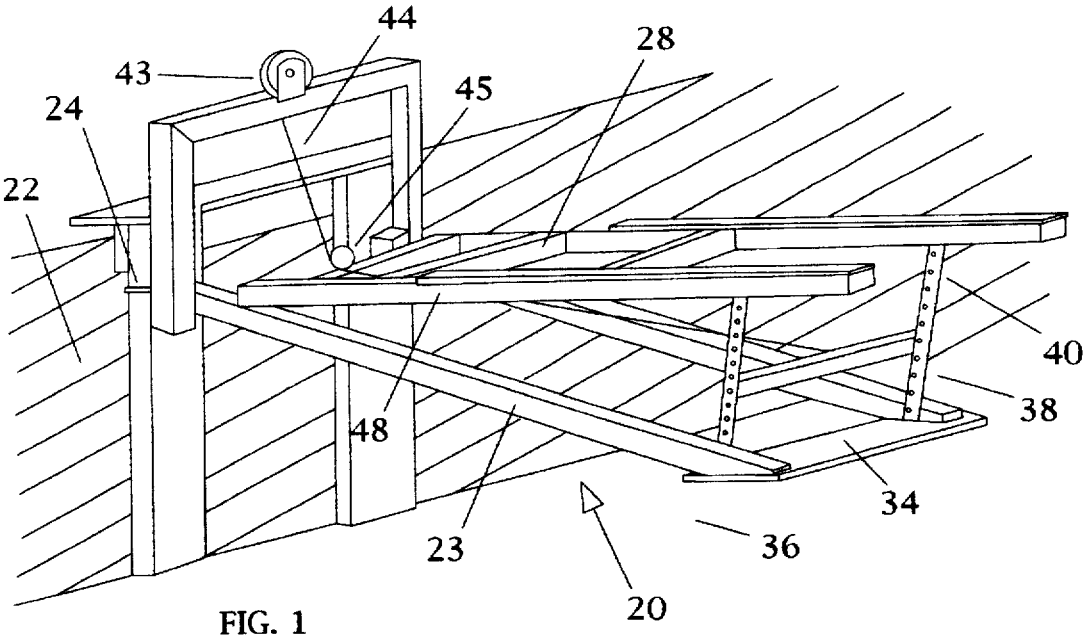
FIG. 1 is a perspective view of a boat lift which is manually lifted.

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention.

DESCRIPTION OF THE INVENTION

Turning now to the drawings and more particularly to FIG. 1 we have a perspective view of a boat lift 20 which is manually lifted. The boat lift 20 is designed to be used adjacent to a pier, retaining wall, or any other type of wharf 22. A wharf attachment 24 mounted to the wharf 22 above the water 26 hingedly supports a wharf end portion of a frame 28 above water 30. A footing 34 seated on the water bed 36 beneath the outer end portion of the frame 28 is hinged to a lower end portion of a lower scissor arm 38. An upper scissor arm 40 having a top end portion which is hinged to the outer portion of the frame 28 has a lower end portion which is hinged to top end portion of the lower scissor arm 38 so that when the scissor arms 38, 40 are longitudinally in-line the frame is in an elevated position and when the scissor arms are bent, then the outer end portion of the frame 28 is in a lowered position beneath the water 30 as is shown in ghost in FIG. 2. FIG. 1 shows a manual opening/closing means which is a winch 43, cable 44, and pulley 45 which is used to alternatively fold the scissor arms 38, 40 together and then open them to a straight in-line position. When the scissor arms 38, 40 are in a closed position the outer end portion of the frame 28 is in a lowered position beneath the water 30 so that a boat 42 may be driven above the frame 28 onto the wharf end portion thereof, and then when the scissor arms 38, 40 are straightened to an in-line position the boat 42 is first fully seated on the frame 28 and then lifted out of the water 30. The boat lift 20 shown in FIG. 1 also comprises a stationary spacer beam 23 which extends between and spaces the footing 34 and the wharf attachment means 24. Use of a spacer beam eliminates the need to pin or otherwise anchor the footing 34 onto the water bed 36.

Figure 2:
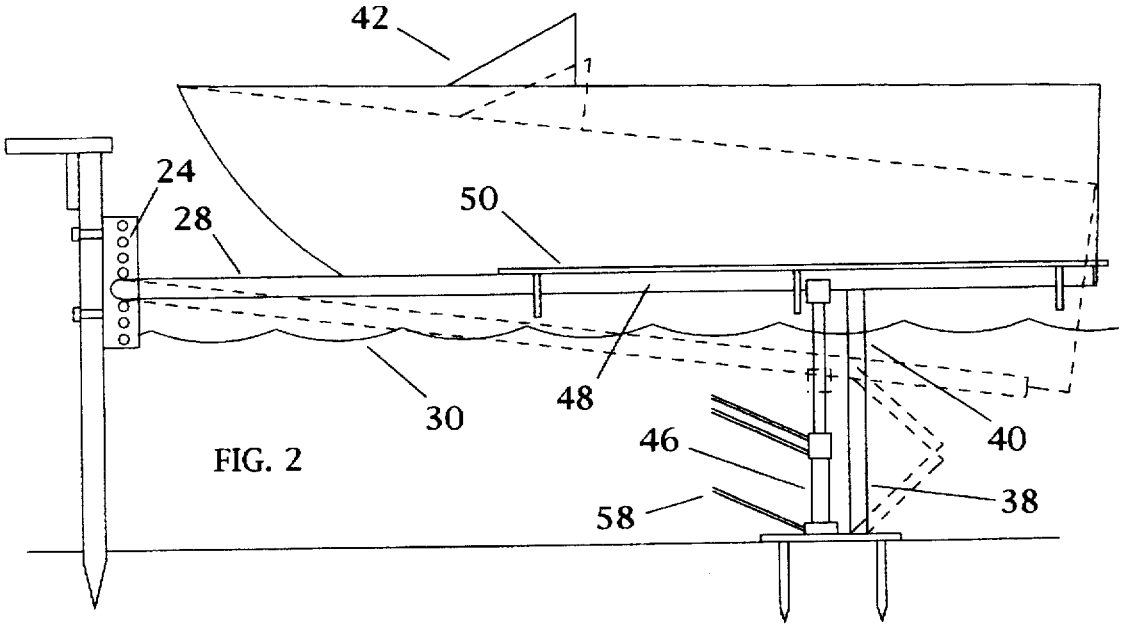
FIG. 2 is an elevational view of a boat lift which is hydraulically operated.

FIG. 2 is an elevational view of a boat lift 20 which is hydraulically operated by a hydraulic cylinder 46. The hydraulic cylinder 46 has a lower end portion which is carried by the footing 34, and an upper end portion which carries the frame 28. FIG. 2 also shows a preferred arrangement wherein the frame 28 may be hinged to the wharf attachment 24 at varying heights. One of the scissor arms 38 or 40, and preferably the upper scissor arm 40 may be elongated to provide for adjustment for varying water 30 levels. In one embodiment the boat lift is fabricated from metal. Aternatively, the boat lift 20 may be fabricated from pressure treated wood. The frame 28 comprises two main lift beams 48 each having a wharf end hinged to the wharf attachment 24 and each having an outer end portion hinged to an upper scissor arm 40.

The boat lift 20 further comprises two secondary lift beams 50 each being aligned with and spaced above a main lift beam 48. Spacing pins 54 which extend from the secondary 50 to the main lift beams 48 provide for adjustable spacing therebetween.

Figure 3:
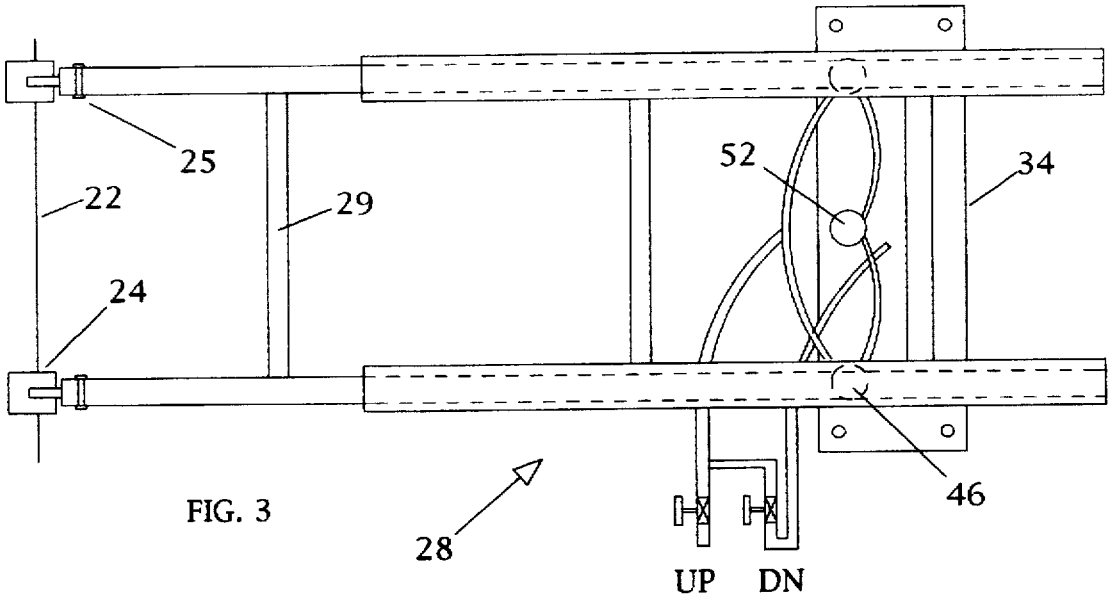
FIG. 3 is a plan view of the hydraulic boat lift shown in FIG. 2.

FIG. 3 is a plan view of the hydraulic boat lift shown in FIG. 2. FIG. 2 shows said frame 28 comprising two main lift beams 48 each having a wharf end hinged to the wharf attachment 24 and each having an outer end portion positioned above a footing 34 upon which it is supported by scissor arms 38, 40 and hydraulic cylinders 46. Cross members 29 extend laterally between the main lift beams 48. FIG. 3 also shows a pressure equalization valve 52 which equalizes the amount of water expelled from each hydraulic cylinder 46 during lifting, thereby ensuring equal lift rates across the frame 28, regardless of an uneven load. The hinges 25 on the wharf end portion of the frame 28 and cross members 29, also ensure balanced lifting.

Figure 4:
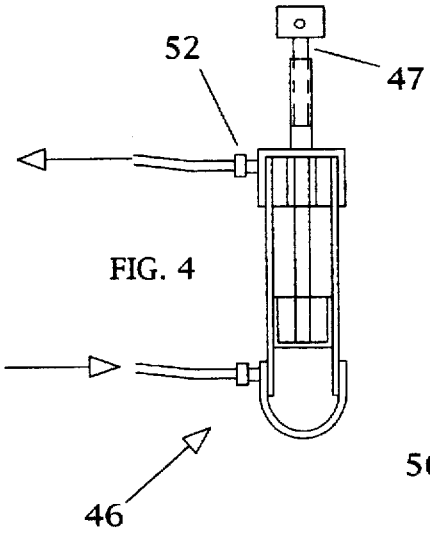
FIG. 4 is an enlarged cross sectional view showing the construction of a PVC hydraulic cylinder.

FIG. 4 is an enlarged cross sectional view showing the construction of the PVC hydraulic cylinder 46. In the preferred embodiment the hydraulic cylinder 46 is fabricated from polyvinylchloride or PVC pipe and the hydraulic fluid is water. Plumbing outlets stock multiple diameters of both the pipe and fittings used in the fabrication of the hydraulic cylinders 46, so that the hydraulic cylinders 46 may be built a selected length for a given lift height, and a selected diameter for any weight of boat 42. FIG. 4 also best shows a threaded rod 47 used to screwingly elongate the hydraulic cylinder 46 to provide for varying water 30 levels.

The boat lift 20 is raised by opening of the UP water valve to supply pressurized water to the base of the hydraulic cylinders 46 which causes them to elongate and lift the frame 28. The scissor arms 38, 40 guide the frame 28 upwards and automatically lock it in the uppermost position when the scissor arms 38, 40 align and the UP water pressure is removed. To lower the frame 28 of the boat lift 20 it is first necessary to open the UP water valve to unlock the scissor arms 38, 40. A down DN water valve is then opened. On smaller boat lifts 20, for smaller boats 42, opening the DN valve directs expelled water against the scissor arms 38, 40 so that they are forced to bend from their in-line position.

Figure 5:
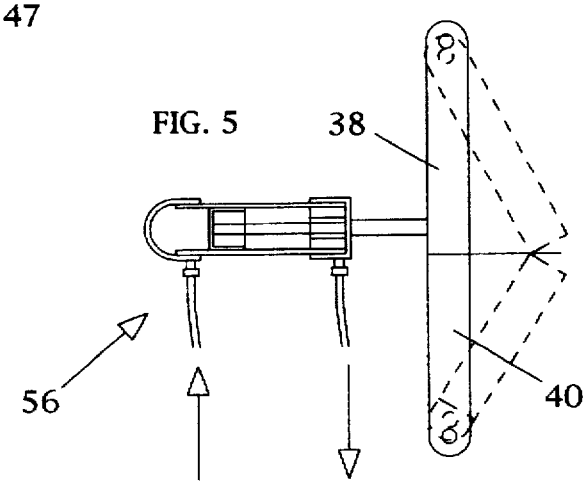
FIG. 5 is an enlarged elevational view of an optional hydraulic scissor arm release cylinder.

FIG. 5 is an enlarged elevational view of a hydraulic scissor arm release cylinder 56 which is used on larger boat lifts 20. The hydraulic scissor arm release cylinder 56 is powered by down exhaust fluid. It forces the scissor arms 38, 40 from an in-line position prior to lowering of the frame 28 to an unlocked position shown in ghost thereby beginning the downward movement of the frame 28.

The disclosed design for a boat lift 20 is readily sized to the size of the boat 42 which is to be lifted. Small boats 42 may be lifted manually with a winch 43. Larger boats 42 require a stronger frame 28 and boat lift 20, together with two or more hydraulic lift cylinders 46. The lifting capacity of the hydraulic cylinders 46 is directly proportional to the available water pressure and their inner diameter. If the hydraulic cylinders 46 are positioned under the frame 28, behind the center of gravity of the boat 42 then they have some mechanical leverage. Coversely, if they are ahead of the center of gravity then they will lift faster, but with less power. Because the wharf end portion of the frame 28 of the boat lift 20 is hinged above water 30 level to the wharf attachment 24, and a boat 42 normally has a center of gravity near its rear end portion, the boat 42 may be readily driven onto the boat lift 20 when it is in a lowered position. As the boat lift 20 is raised the secondary lift beams 50 guide it to a position centered above the frame 28. The hydraulic cylinders 46, positioned beneath the outside end portion of the frame 28, generally coincide with the longitudinal center of gravity of the boat 42 and it is readily lifted out of the water 30.

Figure 6:
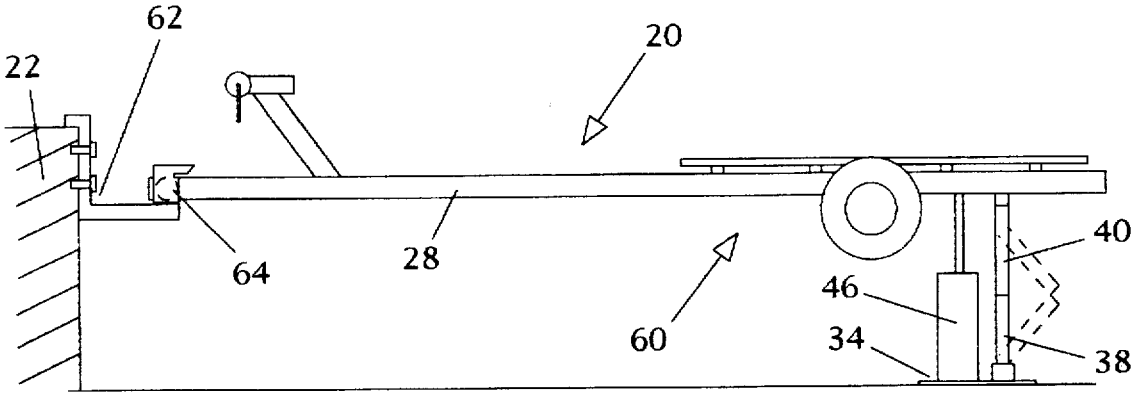
FIG. 6 is an elevational view of a boat lift which utilises a boat trailer for a frame.

FIG. 6 is an elevational view of a boat lift 20 which utilises a prefabricated boat trailer 60 for a frame 28. A wharf—hitch support member 62 has a ball 64 on a trailer end portion and is adapted to be fastened to the wharf 22 on its other opposite end portion. The rear end portion of the boat trailer 60, as before is provided with a hydraulic cylinder 46 having a lower end portion which is carried by a footing 34, and an upper end portion which carries the frame 28. Scissor arms 38,40 extending between the footing 34 and the frame 28 are additionally shown. Utilization of an existing boat trailer 60, usually present for transporting a boat, designed specifically for the boat, and needing a storage place when not in use, enables one to inexpensively assemble a boat lift 20.

While the invention has been described with preferred specific embodiments thereof, it will be understood that this description is intended to illustrate and not to limit the scope of the invention, which is defined by the following claims.

I claim:

1. A boat lift for lifting a boat above the water adjacent to a wharf on a water bed comprising:

a wharf attachment mounted to a portion of the wharf above the water;

a frame having a wharf end portion hingably attached to the wharf attachment;

a footing seated on the water bed beneath an outer end portion of the frame;

an upper scissor arm having a top end portion which is hinged to the outer end portion of the frame;

a lower scissor arm having a top end portion which is hinged to a lower end portion of the upper scissor arm and a lower end portion which is hinged to the footing therebelow; and opening/closing means for alternatively folding the scissor arms together and opening the scissor arms to a straight in-line position;

whereby when the scissor arms are in a closed position the outer end portion of the frame is in a lowered position beneath the water so that a boat may be driven above the frame onto the wharf end portion of the frame, and then when the scissor arms are straightened to an in-line position the boat is first fully seated on the frame and then lifted out of the water.

2. A boat lift as in claim 1 wherein the opening/closing means comprises a winch, carried by the wharf attachment, a pulley carried by the frame, and a cable connecting the winch and the scissor arms, whereby the winch may be used to straighten the scissor arms into an in-line position, thereby lifting the boat out of the water.

3. A boat lift as in claim 1 wherein the opening/closing means comprises a hydraulic cylinder seated on the footing, and extending upwardly to connect to the frame.

4. A boat lift as in claim 3 wherein the hydraulic cylinder is fabricated from PVC pipe.

5. A boat lift as in claim 4 wherein the hydraulic fluid is water.

6. A boat lift as in claim 5 further comprising a second hydraulic cylinder and a pressure equalization valve positioned on the exhaust side of the hydraulic cylinders to equalize their lifting force and travel.

7. A boat lift as in claim 5 wherein the piston is threadedly engaged to the hydraulic cylinder, whereby the length of the hydraulic cylinder and piston may be screwingly adjusted for varying water depths.

8. A boat lift as in claim 1 wherein the wharf attachment defines a plurality of attachment points at varying heights to which the frame may be attached and a scissor arm may be elongated to provide for adjustment for varying water depths.

9. A boat lift as in claim 1 wherein the frame and scissor arms are fabricated from metal.

10. A boat lift as in claim 1 wherein the frame and scissor arms are fabricated from pressure treated wood.

11. A boat lift as in claim 1 wherein said frame comprises two main lift beams each having a wharf end hinged to the wharf attachment and each having an outer end portion hinged to an upper scissor arm.

12. A boat lift as in claim 1 further comprising a stationary spacer beam which extends between and spaces the footing and the wharf attachment means.

13. A boat lift as in claim 11 which further comprises a secondary lift beam carried by and aligned with each main lift beam.

14. A boat lift as in claim 13 further comprising at least one spacing pin which extends from each secondary lift beam to a corresponding-supporting main lift beam, thereby allowing adjustment of the spacing between each main lift beam and the corresponding supported secondary lift beam.

15. A boat lift as in claim 1 wherein the frame comprises a prefabricated boat trailer.

16. A boat lift for use with an existing boat trailer having a frame, comprising:

a wharf attachment mounted to the wharf above the water, said wharf attachment having a ball for connection to the boat trailer;

a footing seated on the water bed beneath the outer end portion of the frame;

upper scissor arm having a top end portion which is hinged to the outer portion of the frame;

a lower scissor arm having a top end portion which is hinged to the lower end portion of the upper scissor arm and a lower end portion which is hinged to the footing therebelow; and opening/closing means to alternatively fold the scissor arms together and open them to a straight in-line position;

whereby when the scissor arms are in a closed position the outer end portion of the frame is in a lowered position beneath the water so that a boat may be driven above the frame onto the wharf end portion thereof, and then when the scissor arms are straightened to an in-line position the boat is first fully seated on the frame and then lifted out of the water.

* * * * *